US005341065A

United States Patent [19]

Uemura et al.

[11] Patent Number: 5,341,065

[45] Date of Patent: Aug. 23, 1994

[54] LIGHT-EMITTING DEVICE

[75] Inventors: Sashirou Uemura; Yoshiyuki Nishii; Isamu Kanda, all of Mie; Zenichiro Hara, Nagasaki; Shunichi Futatsuishi, Nagasaki; Kozaburo Shibayama, Nagasaki, all of Japan

[73] Assignees: Ise Electronics Corporation, Ise; Mitsubishi Denki Kabushiki Kaisha, Tokyo, both of Japan

[21] Appl. No.: 842,602

[22] Filed: Feb. 27, 1992

[30] Foreign Application Priority Data

Jun. 25, 1991 [JP] Japan ..... 3-153084

[51] Int. Cl.[5] ..... H01J 63/06

[52] U.S. Cl. ..... 313/495; 313/493; 313/496; 313/292

[58] Field of Search ..... 313/495, 485, 493, 496, 313/497, 512, 634, 292; 315/169.3, 169.4; 340/781, 784; 345/37

[56] References Cited

U.S. PATENT DOCUMENTS 4,274,028 6/1981 Frame ..... 313/495 X
4,659,963 4/1987 Huber ..... 313/493
4,829,213 5/1989 Pecile et al. ..... 313/512 X
4,855,640 8/1989 Caple ..... 313/495 X
4,893,056 1/1990 Hara et al. ..... 313/495

FOREIGN PATENT DOCUMENTS 57-189452 11/1982 Japan .
62-10849 1/1987 Japan .
64-995 1/1989 Japan .

*Primary Examiner*—Donald J. Yusko
*Assistant Examiner*—Ashok Patel
*Attorney, Agent, or Firm*—Burns, Doane, Swecker & Mathis

[57] ABSTRACT

A light-emitting device having front and back panels combined together through a spacer and frit glass, wherein the frit glass is prevented from flowing onto a fluorescent surface or flowing out to the outer surface side of the spacer. A joint surface of the spacer on the front panel side is provided with a slanted surface spaced more from the front panel as the outer periphery of the light-emitting device is approached. Alternatively, a gap for accommodating frit glass may be provided at an outer side portion of the joint surface. Further, the front panel and/or the back panel may be joined to the spacer by frit glass which is applied to each joint surface of the spacer by screen printing.

8 Claims, 6 Drawing Sheets

FIG. 6 (PRIOR ART)
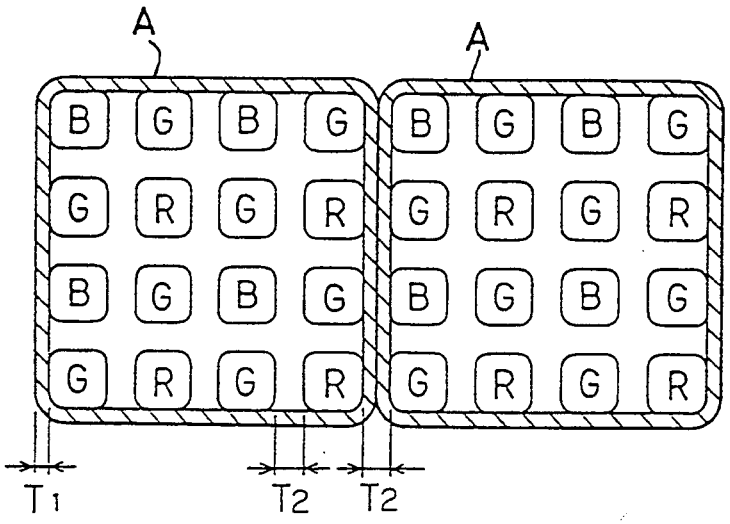
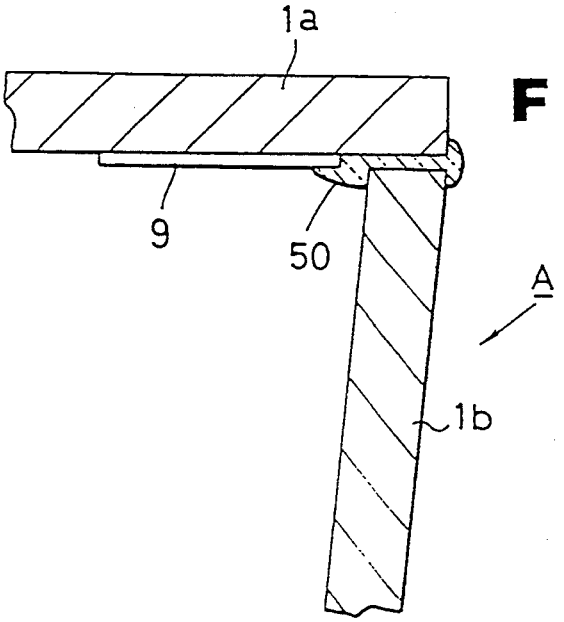
FIG. 7 (PRIOR ART)
FIG. 8 (PRIOR ART)
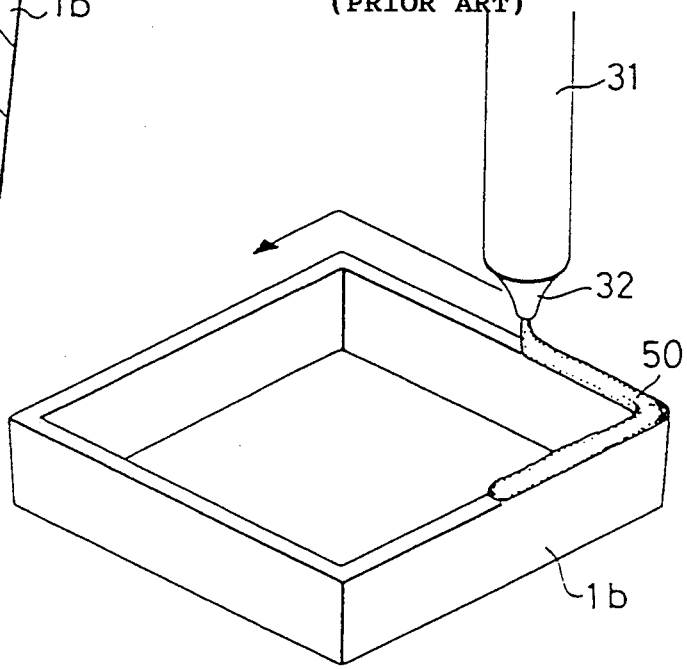

LIGHT-EMITTING DEVICE

BACKGROUND OF THE INVENTION (1) Field of the Invention

This invention relates to a light-emitting device for constituting a large-screen display device to be used for a stadium or the like.

(2) Description of the Prior Art

Referring to FIG. 1, there is shown an exploded perspective view of a display device according to the prior art, as for example disclosed in Japanese Patent Application Laid-Open (KOKAI) No. 64-995 (1989). In the figure, reference character 1*a* denotes a front panel which is coated with a fluorescent material so as to function as a display portion, reference character 1*b* denotes a box-like spacer to which the display portion 1*a* is attached as a cover face, and 1*c* denotes a back panel attached to the spacer 1*b* as a bottom face of the box and serving as a substrate on which various control electrodes are mounted. These members are combined together to constitute a vacuum vessel of a display tube. Line form cathodes 2 are provided on the substrate 1*c*, together with first control electrodes (scanning electrodes) 3 and second control electrode (data electrodes) 4. Wiring patterns 5 and 6 are provided for common interconnections of the two kinds of control electrodes 3 and 4 in a row direction and a column direction, respectively. A shielding electrode 7 is provided with apertures 8 corresponding to light-emitting portions. Numeral 9 denotes a fluorescent material, and 10 an exhaust portion. FIG. 2 illustrates the layout and wiring of the two kinds of control electrodes 3 and 4. Reference characters S1 to S4 denote lead portions of the scanning electrodes 3, which are interconnected in common in the row direction, and D1 to D4 denote lead portions of the data electrodes 4, which are interconnected in common in the column direction. FIG. 3 shows the timings of signals which are impressed on the control electrodes 3 and the data electrodes 4. FIG. 4 shows an arrangement of pixels P11 to P14 and the correspondence thereof with the electrodes, and FIG. 5 illustrates the potential of each electrode and the flow of electrons. Furthermore, FIG. 6 shows an example of a display having a multiplicity of arrayed light-emitting devices (two of them are shown), and FIG. 7 is a fragmentary sectional view of the light-emitting device.

The fundamental principle in operation of this type of display device is that thermions emitted from the cathode 2 are accelerated to collide against the anode, whereby the fluorescent material applied to the anode surface is excited to emit light. In FIG. 5, the behavior of the thermions emitted from the cathode 2 depends on the combination of the potentials at the first control electrode (scanning electrode) 3 and the second control electrode (data electrode) 4. That is, the thermions behave in the manner as described below (the description is made with reference to FIG. 5).

[1] When the scanning electrode 3, interconnected in the row direction, and the data electrode 4, interconnected in the column direction, are both positive in potential relative to the cathode 2:

The electrons emitted from the cathode 2 by the positive potential of the data electrode 4 are deflected by the potential of the scanning electrode 3 so as to pass through a predetermined aperture and reach the anode, thereby causing the fluorescent material 9 to emit light.

[2] When the scanning electrode 3 is positive and the data electrode 4 is negative:

The negative potential of the data electrode 4 closer to the cathode 2 renders the potential in the vicinity of the cathode 2 negative, whereby emission of thermions is restrained. Therefore, the fluorescent material 9 does not emit light.

[3] When the scanning electrode 3 is negative and the data electrode 4 is positive, there are two situations:

(a) When the scanning electrode 3 on the other side is positive, the thermions emitted from the cathode 2 are deflected by the potential of the scanning electrode 3 to the side of the other scanning electrode 3, so that the fluorescent material 9 does not emit light.

(b) When the scanning electrode 3 on the other side is also negative, the potential in the vicinity of the cathode 2 becomes negative under the influence of the negative potential of the scanning electrodes 3 on both sides, because the data electrode 4 having the positive potential is small in area. Therefore, the emission of the thermions is restrained, and the fluorescent material 9 does not emit light.

[4] When both the scanning electrode 3 and the data electrode 4 are negative:

The potential in the vicinity of the cathode 4 becomes negative, so that the emission of thermions is restrained, and the fluorescent material 9 does not emit light.

Taking into account the relationship between the interconnection shown in FIG. 2 and the array of pixels shown in FIG. 4, therefore, fluorescent light is emitted from the fluorescent materials 9 located at intersections of the row (scanning) electrodes and column (data) electrodes which are supplied with positive potentials. First, when a signal is impressed on the lead portion S1, the pixels P11 to P14 are selected for emitting light according to the potential of the lead portions D1 to D4 of the data electrodes. Next, with a signal applied to the lead portion S2, the pixels P21 to P24 are similarly selected for emitting light according to the potential at the data electrodes. Namely, as shown in FIG. 3, an arbitrary display can be obtained by applying a serial scanning signal to the scanning electrodes 3 and appropriate data signals to the data electrodes 4. FIG. 6 shows an example of a display in which a multiplicity of light-emitting devices A are arrayed. In order that the joint between two light-emitting devices A may be inconspicuous, a space T2 not less than two times the dead space (width: T1) at the periphery of each light-emitting device A should be present between pixels in the device A. FIG. 7 shows a fragmentary sectional view of the light-emitting device A. A front panel 1*a* is coated with a fluorescent material 9 by screen printing. Practically, an aluminum film is vapor-deposited on the surface of the fluorescent material 9, though not shown in the figure. Further, a spacer 1*b* and a back panel 1*c* are sealed with frit glass 50. Control electrodes 20 for letting signals out of the light-emitting device A are led out through the seal portion between the spacer 1*b* and the back panel 1*c*, as shown in FIG. 1, but the electrodes 20 may be led out directly from the back panel 1*c*. The joining of the front panel 1*a* and the spacer 1*b* is, as shown in FIG. 8, carried out by moving a dispenser 31 once along the entire length of the joint surface of the spacer 1*b* while ejecting the frit glass 50 from a nozzle 32 of the dispenser 31, and pressing the frit glass 50 supplied on the spacer 1*b* against the front panel 1*a*. The joining of the back panel 1*c* and the spacer 1*b* is performed in a similar manner.

The light-emitting devices according to the prior art have the construction as above. Therefore, in order to achieve a close arrangement of the light-emitting devices A and thereby obtain normal images, uniformity of the pixel arrangement in a display should be maintained with high accuracy as shown in FIG. 6. According to the prior art, however, the frit glass 50 at the seal portion between the front panel 1*a* and the spacer 1*b* would flow onto the fluorescent material 9 of the display portion 1*a*, as shown in FIG. 8, thereby damaging the uniformity of the pixel arrangement. There has also been the problem that the frit glass 50 would flow out to the outer side of the spacer 1*b*, thereby hindering close arrangement of the light-emitting devices A. The flowing-out of the frit glass 50 arises from the uneven coating amount of the frit glass 50 due to the use of the dispenser 31, as shown in FIG. 8, for application of the frit glass 50. For example, the dispenser 31 is moved once along the joint portion (the portion to be coated with the frit glass) of the spacer 1*b* while ejecting the frit glass 50 through the nozzle 32. In carrying out this operation, it is difficult to make constant both the quantity of the frit glass 50 ejected from the nozzle 32 and the moving speed of the dispenser, especially at corner portions of the spacer 1*b*. Consequently, the coating amount of the frit glass 50 varies from place to place, making it necessary, after the sealing step, to grind off the frit glass 50 protruding from the joint portions between the spacer 1*b* and the front and back panels 1*a*, 1*c*. Such a grinding step leaves minute flaws on the ground portions, thereby lowering the strength of the glass vessel, resulting in that the light-emitting device obtained cannot be guaranteed for long-term reliability.

SUMMARY OF THE INVENTION

This invention contemplates overcoming the above problems associated with the prior art.

It is accordingly an object of this invention to provide a light-emitting device of high quality which can be manufactured with no flow of frit glass onto the surface of a fluorescent material, at a joint portion between a front panel and a spacer, with a reduced dead space and, hence, with a uniform pixel arrangement.

It is another object of this invention to provide a light-emitting device of high reliability which can be produced without any outflow (or protrusion) of frit glass from joint portions between a spacer and front and back panels to the outer surface side of the spacer and, hence, without need for subsequent grinding of such protruding frit glass.

In one light-emitting device according to this invention, a joint surface of a spacer on the side of a front panel is provided with a slant surface, the slant surface being so slanted as to be spaced more from the front panel as an outer surface of the spacer is approached, and the spacer and the front panel are joined to each other by frit glass supplied in a gap generated between the spacer and the front panel due to the presence of the slant surface.

In another light-emitting device according to this invention, gaps for accommodating frit glass are provided at the outer surface side of joint surfaces between a spacer and front and back panels.

In a further light-emitting device according to this invention, a front panel and/or a back panel is joined to a spacer by frit glass which is applied to the panel by screen printing.

The slant surface functions so that, at the time of joining the front panel and the spacer to each other, the frit glass present therebetween is squeezed toward the outer surface side of the spacer and is prevented from spreading onto a fluorescent material provided on the front panel on the inner surface side of the spacer.

The gap gradually widened toward the outer surface side at the joint surface between the spacer and the front panel and/or the back panel has such a function that, at the time of joining the front panel and/or the back panel to the spacer, the portion being squeezed outwards of the frit glass present between the panel and the spacer is retained in the gap and, therefore, prevented from flowing out to the outer surface side of the spacer.

The frit glass is applied, by screen printing, to the joint surface of the spacer on the side of the front panel and/or the back panel, in the form of a thin uniform layer. Therefore, the frit glass can be securely prevented from spreading out of the area of the joint surface.

BRIEF DESCRIPTION OF THE DRAWINGS

FIG. 6 is an illustration of two adjacent light-emitting devices;

FIG. 7 is a fragmentary sectional view showing a part of the light-emitting device according to the prior art;

FIG. 8 is a perspective view for illustrating a process for applying frit glass to a spacer;

DETAILED DESCRIPTION OF THE PREFERRED EMBODIMENTS

One embodiment of this invention will now be described below with reference to the drawings.

Figure 9:
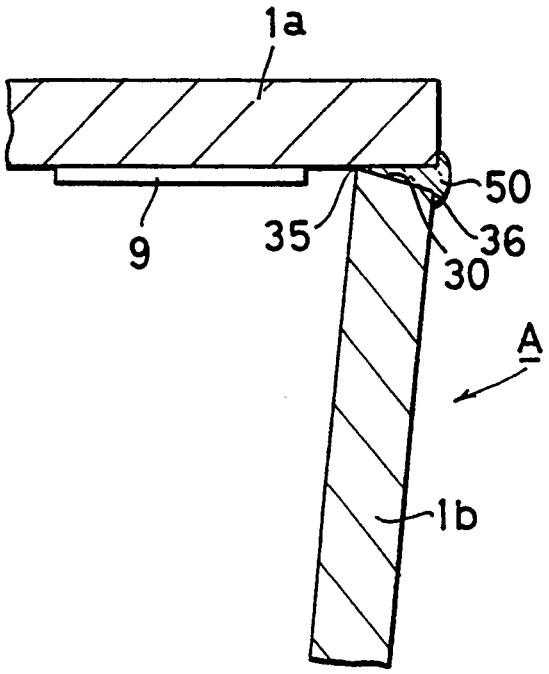
FIG. 9 is a sectional view of an important part of a light-emitting device according to a first embodiment of this invention.

Referring to FIG. 9, there is shown a slant surface 30 provided at a joint surface of a spacer 1*b* on the side of a front panel. When an inner edge 35 of the joint surface of the spacer 1*b* is brought into contact with the front panel 1*a*, the slant surface 30 forms a gap between the front panel 1*a* and an outer edge 36 of the joint portion of the spacer 1*b*. Frit glass 50 is supplied into the gap, whereby the front panel 1*a* and the spacer 1*b* are joined to each other.

Figure 1:
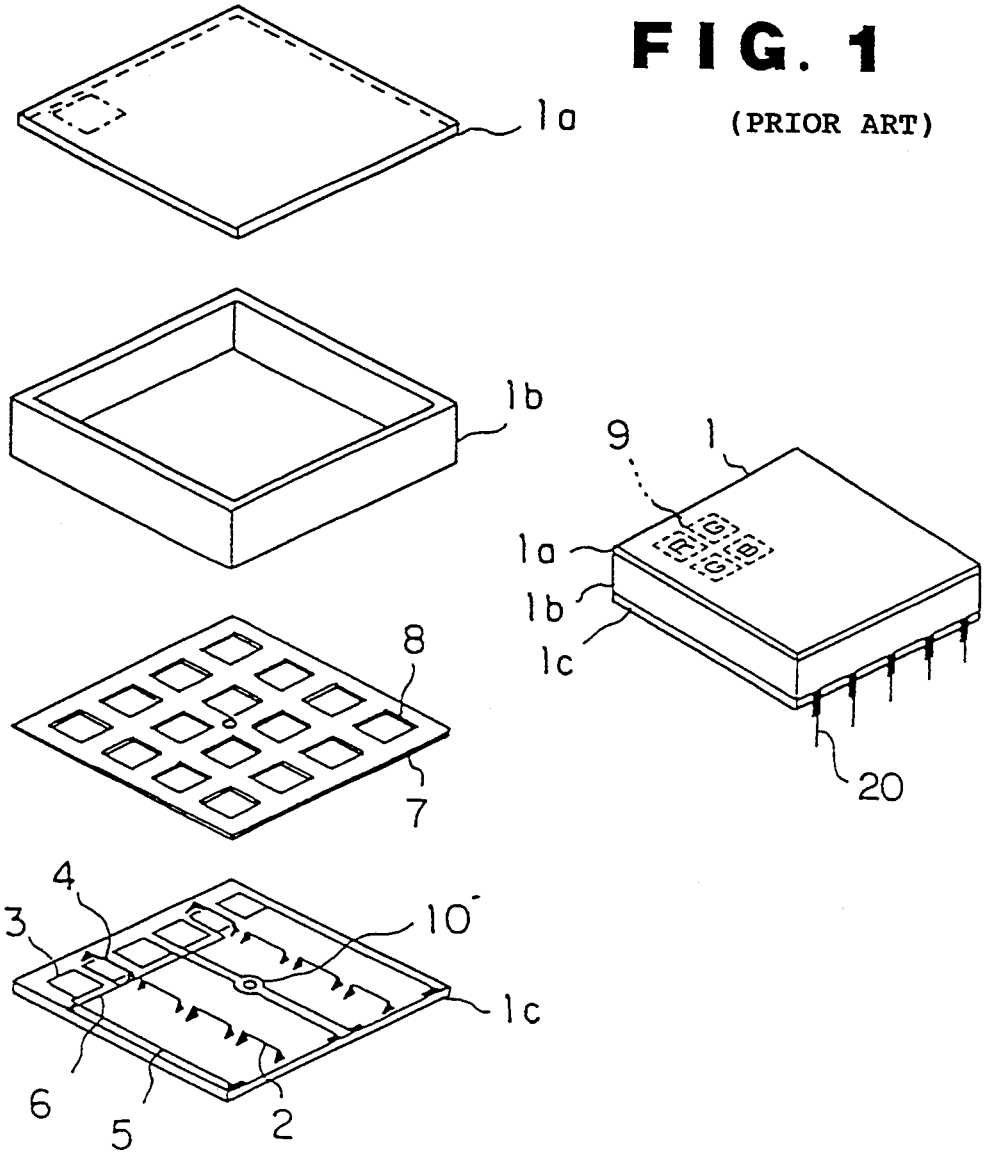
FIG. 1 (PRIOR ART)
FIG. 1 is an exploded perspective view of a light-emitting device according to the prior art.
Figure 2:
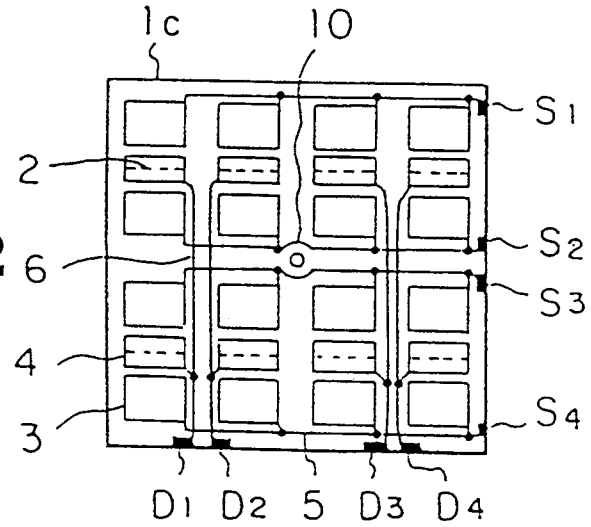
FIG. 2 (PRIOR ART)
FIG. 2 is a wiring diagram showing the wiring for control electrodes of a light-emitting device.
Figure 3:
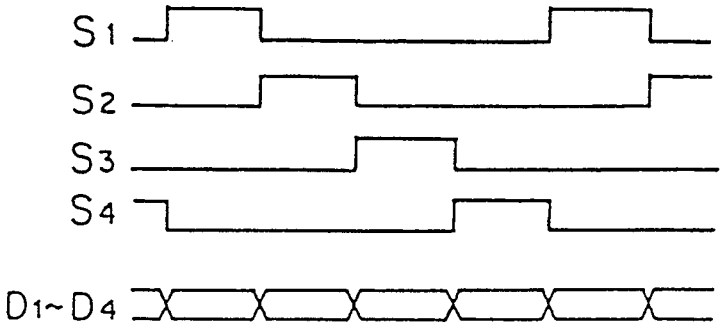
FIG. 3 (PRIOR ART)
FIG. 3 is a timing chart for signals applied to control electrodes and data electrodes.
Figure 4:
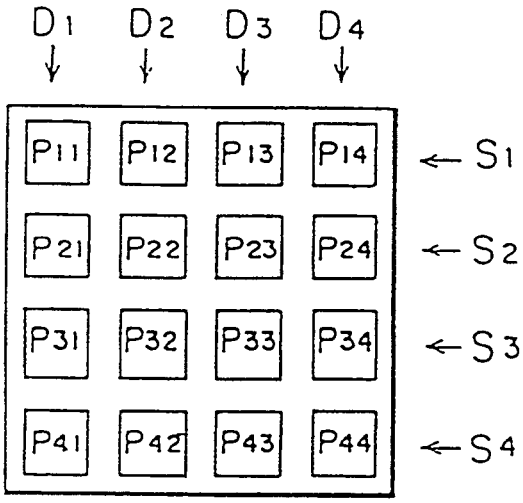
FIG. 4 (PRIOR ART)
FIG. 4 is an illustration of the correspondence between pixels and electrodes.
Figure 5:
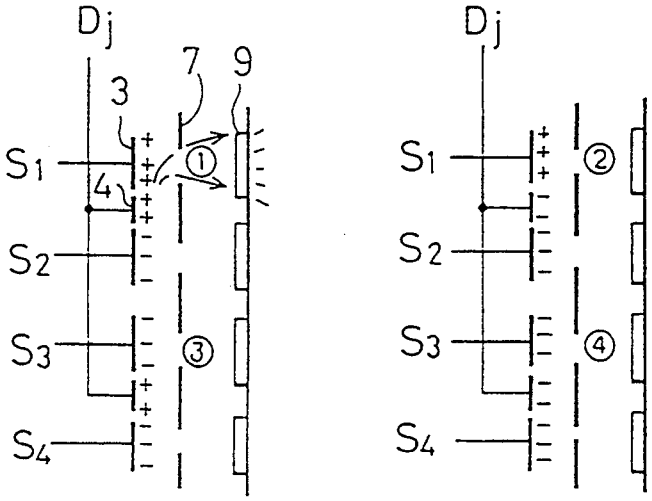
FIG. 5 (PRIOR ART)
FIG. 5 is an illustration of the polarity of electrodes and the flow of electrons.

The overall construction of a light-emitting device is the same as that shown in FIG. 1, and control electrodes are laid out and wired as shown in FIG. 2. Further, the arrangement of pixels is the same as shown in FIG. 4, and two light-emitting devices are arrayed as shown in FIG. 6.

In operation, first, the joint surface of the spacer 1*b* on the side of the front panel 1*a* is the slant surface 30, which is coated with the frit glass 50. In the subsequent sealing step, the front panel 1*a* and the spacer 1*b* are combined together and heated. Under the heating, the frit glass 50 is softened and the inner edge 35 of the joint surface of the spacer 1*b* on the side of the front panel 1*a* is brought into contact with the front panel 1*a*. With further heating, the frit glass 50 is melted to stay in the gap between the front panel 1*a* and the joint surface of the spacer 1*b*. Because the inner edge 35 of the joint surface of the spacer 1*b* is in contact with the front panel 1*a*, the frit glass 50 is prevented from flowing to the side of a fluorescent material 9. This results in a reduced dead space at the joint between the light-emitting devices A, and enables fabrication of the light-emitting devices A with high quality.

Although the above embodiment has been explained with reference to the case where the control electrodes 3 and 4 are disposed on the back side of cathodes 2, the control electrodes 3, 4 can be arranged between the cathodes 2 and anodes. In addition, the cathodes 2 and the pixels P11 to P44 have been described above as being in a one-to-two correspondence, but they may also be in a one-to-one or one-to-n correspondence. Furthermore, although the control electrodes 3 and 4 in the above embodiment are arranged on a substrate 1*c* which constitutes part of a vacuum vessel 1, a construction may be adopted in which the control electrodes 3 and 4 are arranged on other flat plate disposed in the vacuum vessel 1.

Figure 10A:
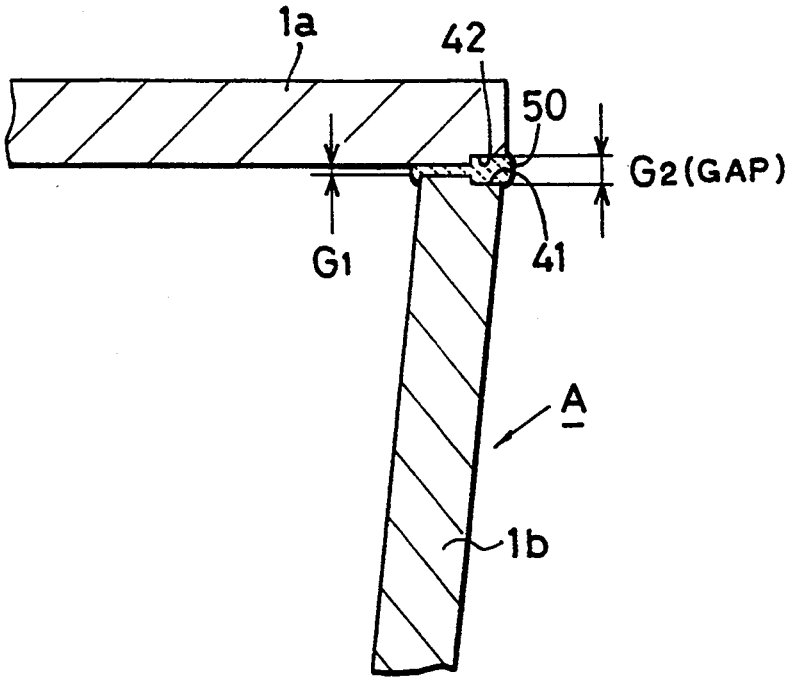
FIGS. 10A and 10B are sectional views of an important part of a light-emitting device according to a second embodiment of this invention.
Figure 10B:
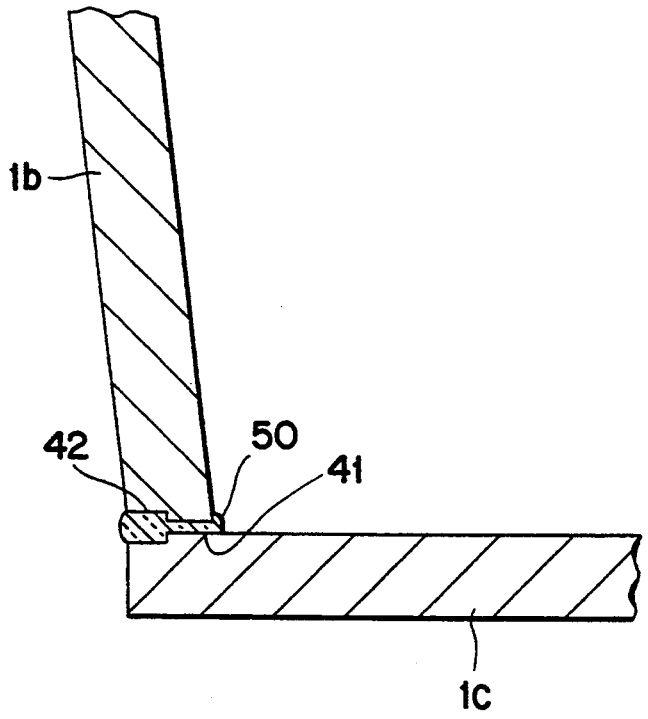
Figure 11:
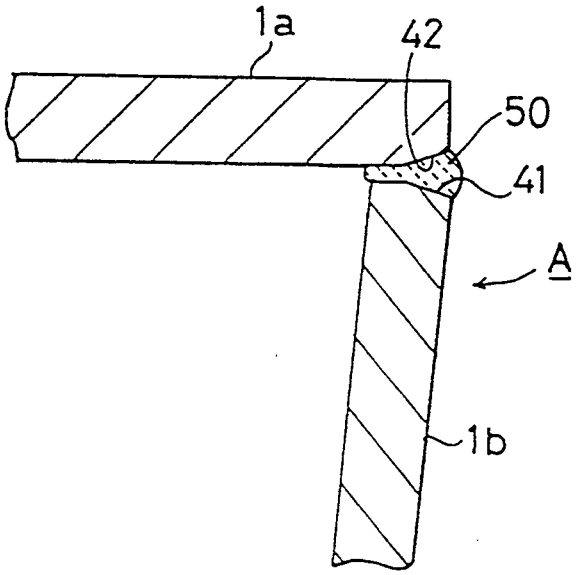
FIG. 11 is a sectional view of an important part of a light-emitting device according to a third embodiment of this invention.

Referring now to FIGS. 10A and 10B, there is shown a second embodiment of this invention. In these Figures, numeral 41 denotes a notch formed in an upper end face of the spacer 1*b* near an outer side surface of the spacer 1*b*, and 42 denotes a notch formed in a lower surface of the front panel 1*a* near an outer side surface of the panel 1*a*. The notches 41 and 42 are joined to each other through frit glass 50 supplied therebetween; in this joint, the gap G2 between the spacer 1*b* and the front panel 1*a* on the outer side is greater than the gap G1 on the inner side. Such gap size relationship can be obtained also by providing only one of the notches 41 and 42. Further, the notches 41 and 42 may be replaced with slant surfaces which, as in a third embodiment illustrated in FIG. 11, are so slanted that the gap therebetween becomes wider in an outward direction. Besides, while FIGS. 10A and 11 show the joint condition of the front panel 1*a* and the spacer 1*b*, a joint condition for the back panel 1*c* and the spacer 1*b* may be the same as that shown FIGS. 10A and 11 as shown FIG. 10B.

In operation, first, the frit glass 50 is applied to a sealing interface between the spacer 1*b* and the front panel 1*a*, prior to sealing. In a sealing step, the spacer 1*b* is combined with the front panel 1*a* and the back panel 1*c*, and the combined assembly is heated to a high temperature. The frit glass 50 is softened by the heating, and the spacer 1*b* is joined to the front panel 1*a* and the back panel 1*c*. Upon further heating, the frit glass 50 is melted to flow into the greater one G2 of the gaps G1 and G2 formed at the joint, and stays in the gap G2. Thus, the frit glass 50 is prevented from flowing out of the interface portion between the front panel 1*a* and the spacer 1*b*. Consequently, the protrusion of the frit glass 50 upon sealing is alleviated, and there is no need for an extra grinding step. The elimination of the need for a grinding step ensures the absence of those minute flaws which would be generated by grinding according to the prior art, and offers a light-emitting device having high reliability.

Figure 12:
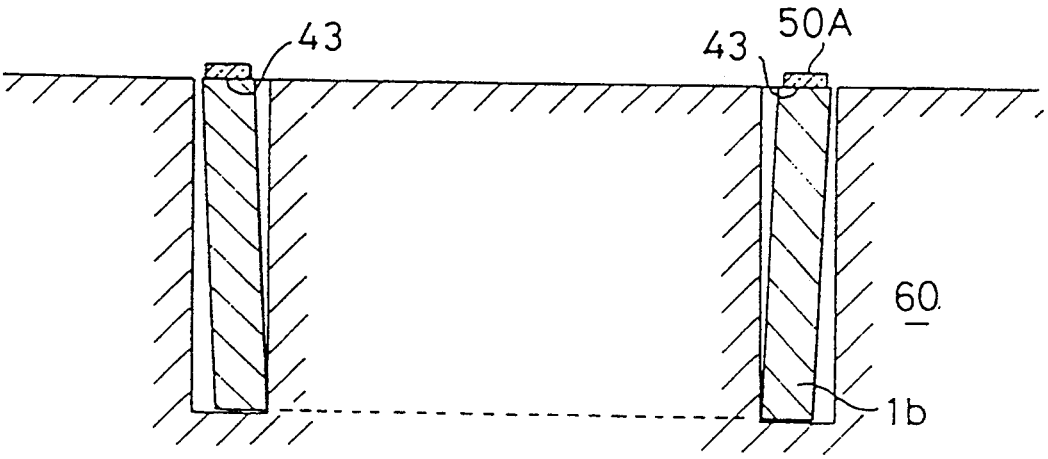
FIG. 12 is a sectional view of an important part of a light-emitting device according to a fourth embodiment of this invention.

Referring now to FIG. 12, there is shown a fourth embodiment of this invention. In this embodiment, frit glass 50A is applied to a joint surface 43 of a spacer 1*b* for joining to a front panel 1*a* (not shown), as a thin layer by screen printing. Namely, the joint surface 43 of the spacer 1*b* is first set horizontal by a jig 60. Next, the joint surface 43 of the spacer 1*b* is coated with the frit glass 50A by screen printing. In carrying out the screen printing, the coating material (in this case, the frit glass material) is turned into a fluid state by use of a solvent. The fluid coating material thus prepared is squeezed through mesh openings onto the joint surface 43. By controlling the fluidity (viscosity) of the frit glass material, it is possible to apply the frit glass 50A in a uniform coating quantity. Besides, a treatment similar to the above can be carried out in joining the pack panel 1 and the spacer 1*b* to each other.

In a sealing step, the spacer 1*b* is combined with the front panel 1*a* and the back panel 1*c*, and the combined assembly is heated to a high temperature. The frit glass 50A is thereby softened, and the spacer 1*b* is joined to each of the panels 1*a*, 1*c*. When the quantity of the frit glass 50A is controlled appropriately, the frit glass 50A is prevented from spreading out of the glass sealing area, and there will be no need to grind the frit glass 50A after the sealing step. As a result, the generation of minute flaws due to grinding, usually the case with the prior art, is obviated and a light-emitting device with high reliability can be obtained. The process for joining a panel and the spacer 1*b*, as illustrated in this embodiment, is not only applicable to the front panel 1*a* alone but is also applicable to the back panel 1*c* alone and to both the front panel 1*a* and the back panel 1*c*, the process being effective in all cases.

As has been described hereinabove, according to this invention, the joint surface of the spacer on the side of the front panel is provided with a slant surface which is so slanted as to be spaced more from the front panel as an outer side surface of the spacer is approached, and the frit glass is supplied in a gap formed between the spacer and the front panel due to the presence of the slant surface, followed by joining the spacer and the front panel to each other. In the joining of the front panel and the spacer, therefore, the frit glass present therebetween is squeezed toward the outer side the spacer. Accordingly, the frit glass will not spread onto the fluorescent material provided on the front panel on the inner side of the spacer.

In addition, when a gap for accommodating the frit glass is provided at joint surfaces between the spacer and the front and back panels in the vicinity of the outer side surface of the spacer, the greater gap on the outer side retains that portion of the frit glass which is moved outwards under a squeezing pressure at the time of joining the spacer and the front and back panels together. Therefore, the frit glass is securely prevented from protruding to the outer side of the spacer.

Furthermore, when the front panel and/or the back panel is joined to the spacer by frit glass which is applied to each relevant joint surface of the spacer by screen printing, the frit glass can be applied to the joint surface of spacer as a thin uniform layer. This leads to assured prevention of the spreading of the frit glass out of the area of the joint surface.

What is claimed:

1. A light-emitting device comprising:

a front panel having an inner surface coated with a fluorescent material in a matrix pattern;

a back panel having a cathode for emitting thermions, and a control electrode for directing the thermions toward the fluorescent material; and a spacer to which the front panel and the back panel are joined gas-tight by frit glass, wherein a joint surface of the spacer on the side of the front panel is slanted so as to be spaced more from the front panel as an outer surface of the spacer is approached.

2. The light-emitting device as set forth in claim 1, wherein the frit glass is supplied into a gap between the spacer and the front panel.

3. The light-emitting device as set forth in claim 2, wherein the spacer is placed as to form a box together with the front panel and the back panel, the front and back panels serving respectively as a cover face and a bottom face of the box.

4. A light-emitting device comprising:

a front panel having an inner surface coated with a fluorescent material in a matrix pattern;

a back panel having a cathode for emitting thermions, and a control electrode for directing the thermions toward the fluorescent material; and a spacer to which the front panel and the back panel are joined gas-tight by frit glass, wherein joint surfaces of the front panel and the back panel for joining the front panel and the back panel to the spacer are provided with notched portions on the side of an outer surface of the spacer, and both joint surfaces of the spacer are provided with notched portions on the side of the outer surface of the spacer.

5. The light-emitting device as set forth in claim 4, wherein each of the notched portions of the joint surfaces is parallel to the remaining, unnotched portion of the relevant joint surface.

6. The light-emitting device as set forth in claim 4, wherein each of the notched portions is slanted so as to be deviated more from the unnotched original plane of the relevant joint surface as the outer surface of the spacer is approached.

7. The light-emitting device as set forth in claim 5 or 6, wherein the frit glass is supplied into gaps between the spacer and the panels.

8. The light-emitting device as set forth in claim 7, wherein the spacer is placed as to form a box together with the front panel and back panel, the front and back panels serving respectively as a cover face and a bottom face of the box.

* * * * *